United States Patent [19]

Gudelis et al.

[11] 4,439,308

[45] Mar. 27, 1984

[54] SOLVENT DEWAXING WAXY BRIGHT STOCK USING A COMBINATION POLYDIALKYLFUMARATE-VINYL ACETATE COPOLYMER AND WAX-NAPHTHALENE CONDENSATE DEWAXING AID

[75] Inventors: David A. Gudelis; Lloyd E. Reid, both of Sarnia, Canada

[73] Assignee: Exxon Research and Engineering Co., Florham Park, N.J.

[21] Appl. No.: 426,712

[22] Filed: Sep. 29, 1982

[51] Int. Cl.[3] ..... C10G 73/04

[52] U.S. Cl. ..... 208/33

[58] Field of Search ..... 208/33

[56] References Cited

U.S. PATENT DOCUMENTS

| | | | |
|---|---|---|---|
| 2,798,027 | 7/1957 | Cohen | 196/19 |
| 3,239,445 | 3/1966 | Leonard et al. | 208/33 |
| 3,262,873 | 7/1966 | Tiedje et al. | 208/33 |
| 3,458,430 | 7/1969 | Henselman et al. | 208/33 |
| 3,475,321 | 10/1969 | Henselman | 208/33 |
| 3,729,296 | 4/1973 | Miller | 44/62 |
| 3,806,442 | 4/1974 | Reid et al. | 208/33 |
| 3,854,893 | 12/1974 | Rossi | 44/62 |
| 4,088,589 | 5/1978 | Rossi et al. | 252/56 |
| 4,153,423 | 5/1979 | Wisotsky | 44/62 |

FOREIGN PATENT DOCUMENTS

| | | |
|---|---|---|
| 1248203 | 8/1967 | Fed. Rep. of Germany . |
| 1248201 | 8/1967 | Fed. Rep. of Germany . |
| 2113780 | 6/1972 | France . |
| 45-44516 | 5/1970 | Japan . |
| 45-122277 | 12/1970 | Japan . |
| 52-44261 | 4/1977 | Japan . |
| 52-77382 | 6/1977 | Japan . |
| 53-122276 | 12/1978 | Japan . |
| 930968 | 7/1963 | United Kingdom . |
| 1151385 | 5/1969 | United Kingdom . |

*Primary Examiner*—Delbert E. Gantz
*Assistant Examiner*—Glenn A. Caldarola
*Attorney, Agent, or Firm*—Joseph J. Allocca

[57] ABSTRACT

This invention relates to processes for solvent dewaxing bright stock waxy raffinate oil employing a dewaxing aid which dewaxing aid is a mixture of (a) poly di alkyl fumarate/vinyl acetate copolymers and (b) a wax-naphthalene condensate. The dewaxing aid mixture is a mixture of (a) poly di alkyl fumarate/vinyl acetate copolymer having a number average molecular weight of about 1,000 to 100,000, preferably 5,000 or greater, possessing alkyl side chain moieties of from $C_{16}$–$C_{24+}$ in length (excluding branching) with an average pendent side chain length of predominantly (>50%) $C_{20}$ and (b) a wax-naphthalene condensation product having a number average molecular weight of about 1,000 and greater. The combination (a) plus (b) may be employed in a weight ratio within the range from about 45/55 to 1/100, preferably about ⅓, and at an aid dose level ranging from about 0.005 to 2.0 wt %, preferably 0.01 to 0.2 wt % active ingredient.

5 Claims, 1 Drawing Figure

VARIATION OF DWO RELATIVE FILTRATION RATE WITH DEWAXING AID MIXTURE COMPOSITION POLYDIAIKYIFUMARATE-VINYLACETATE/WAX-NAPHTHALENE CONDENSATE ON BRIGHT STOCK

Total Additive Treat = 0.10 wt% A.I. (Based on Oil Feed)

VARIATION OF DWO RELATIVE FILTRATION RATE WITH DEWAXING AID MIXTURE COMPOSITION POLYDIAIKYIFUMARATE-VINYLACETATE/WAX-NAPHTHALENE CONDENSATE ON BRIGHT STOCK

Total Additive Treat = 0.10 wt% A.I.
( Based on Oil Feed )

SOLVENT DEWAXING WAXY BRIGHT STOCK USING A COMBINATION POLYDIALKYLFUMARATE-VINYL ACETATE COPOLYMER AND WAX-NAPHTHALENE CONDENSATE DEWAXING AID

DESCRIPTION OF INVENTION

This invention relates to processes for solvent dewaxing bright stock waxy raffinate oil employing a dewaxing aid which dewaxing aid is a mixture of (a) poly di alkyl fumarate/vinyl acetate copolymers and (b) a wax-naphthalene condensate. The dewaxing aid mixture is a mixture of (a) poly di alkyl fumarate/vinyl acetate copolymer having a number average molecular weight of about 1,000 to 100,000, preferably 5,000 or greater, possessing alkyl side chain moieties of from $C_{16}$–$C_{24+}$ in length (excluding branching) with an average pendent side chain length of predominantly (>50%) $C_{20}$; and (b) a wax-naphthalene condensation product having a number average molecular weight of about 1,000 and greater. The combination (a) plus (b) may be employed in a weight ratio within the range from about 45/55 to 1/100, preferably about 1/3, and at an aid dose level ranging from about 0.005 to 2.0 wt% active ingredient, preferably 0.01 to 0.2 wt%.

The solvent dewaxing processes benefited by the use of the present combination dewaxing aid are those using normally liquid solvent systems such as $C_3$–$C_6$ ketones, aromatic hydrocarbons, halogenated hydrocarbons and mixtures thereof.

The waxy oil is a bright stock raffinate from such typical sources as Light Arabian, Kuwait, North Louisiana, West Texas Sour, Western Canadian, Cold Lake heavy crude, etc. The raffinate can be derived from the crude oil or mixture of crude oils by vacuum distillation followed by conventional propane deasphalting of the vacuum residuum to remove the asphaltenes. The resulting deasphalted oil is solvent extracted using either NMP, phenol or furfural, etc., to remove the remaining undesirable aromatics to give a waxy raffinate for subsequent dewaxing. Typical bright stock waxy raffinates have a boiling range of about 500°–700° C., density of about 0.85–0.92 g/cc @ 15° C., a viscosity of about 25–37 cSt/100° C., a pour point of 60°–70° C., a dry wax content of 15–25 wt% for about −90° C. pour point and a Conradson carbon residue value of about 0.3 to 2.0.

This dewaxing aid combination aids in solvent dewaxing processes wherein a waxy hydrocarbon oil bright stock is mixed with a normally liquid dewaxing solvent and a quantity of the recited dewaxing aid combination to form a mixture which is chilled either directly using cold dewaxing solvent or indirectly in heat exchange apparatus to form a slurry comprising wax particles and a solution of dewaxed oil and dewaxing solvent. The dewaxing aid components (a) and (b) may be precombined one with the other for addition to the waxy oil bright stock to be dewaxed, either as such or diluted in a suitable wax-free oil to improve flow properties. Alternatively, the components may be added separately and simultaneously or separately and sequentially at the same or separate points within the process. Even in this embodiment the individual components (a) and (b) may be employed as such or diluted in a suitable wax-free oil to improve flow properties. The wax particles which are precipitated are subsequently separated from the dewaxed oil by any of a number of typical liquid/solid separation processes exemplified by, but not limited to, filtration, settling, centrifugation, etc.

The use of the combination (a) plus (b) results in increased wax separation rates as compared to using no aid at all or using either component individually.

BACKGROUND OF THE INVENTION

Waxes in wax-containing hydrocarbon oils are removed therefrom by chilling the oil to precipitate out the wax and then separating the solid wax particles from the dewaxed oil by solid/liquid separation procedures such as filtration, centrifugation, settling, etc. Industrial dewaxing processes include press dewaxing processes wherein the wax-containing oil, in the absence of solvent, is chilled to crystallize out the wax particles, which are then pressed out by a filter. In general, only light hydrocarbon oil fractions are treated by press dewaxing processes due to viscosity limitations. More widely used are solvent dewaxing processes wherein a waxy oil is mixed with a solvent and then chilled to precipitate the wax as tiny particles or crystals thereby forming a slurry comprising solid wax particles and a solution of dewaxed oil containing dewaxing solvent. The slurry is then fed to a wax separator (e.g., filter) wherein the wax is removed from the homogeneous solution of dewaxed oil and dewaxing solvent. Solvent dewaxing processes are used for heavier oil fractions such as lubricating oil distillates and bright stocks. Typical dewaxing solvents include low boiling point, normally gaseous autorefrigerative hydrocarbons such as propane, propylene, butane, pentane, etc., ketones such as acetone, methyl ethyl ketone (MEK), methylisobutyl ketone (MIBK) and mixtures thereof, aromatic hydrocarbons such as benzene, toluene and xylene as well as mixtures of ketones and aromatic hydrocarbons such as MEK/toluene and acetone/benzene and mixtures of ketones with autorefrigerants such as acetone/propylene.

One of the factors tending to limit the capacity of a solvent dewaxing plant is the rate of wax filtration (i.e., separation in general) from the dewaxed oil, which in turn is strongly influenced by the crystal structure of the precipitated wax. Although the crystal structure of the precipitated wax is influenced by various operating conditions in the dewaxing process, for any given feed it is most strongly influenced by the chilling conditions. The size and structure of the precipitated wax crystals, the amount of oil occluded in the wax crystal and the condition and quantity of the oil left in the crystal are extremely varied and depend on the wax composition and precipitation conditions. These conditions also affect the separation (filtration) rate of the dewaxed oil from the wax and the yield of dewaxed oil. In some cases, most notably when the waxy oil is a bright stock, the wax crystals are of an extremely fine size and not all are separated by filtration, but some leave the filter with the dewaxed oil component which creates an objectionable haze in the oil.

One way of improving the filtration rate and minimizing haze formation is to add a dewaxing aid to the wax containing oil during the dewaxing process.

DESCRIPTION OF THE FIGURE

FIG. I presents the effect on DWO relative filtration rate of varying the component ratios of the combination dewaxing aid used in the present invention to dewax bright stock.

PRESENT INVENTION

Figure 1:
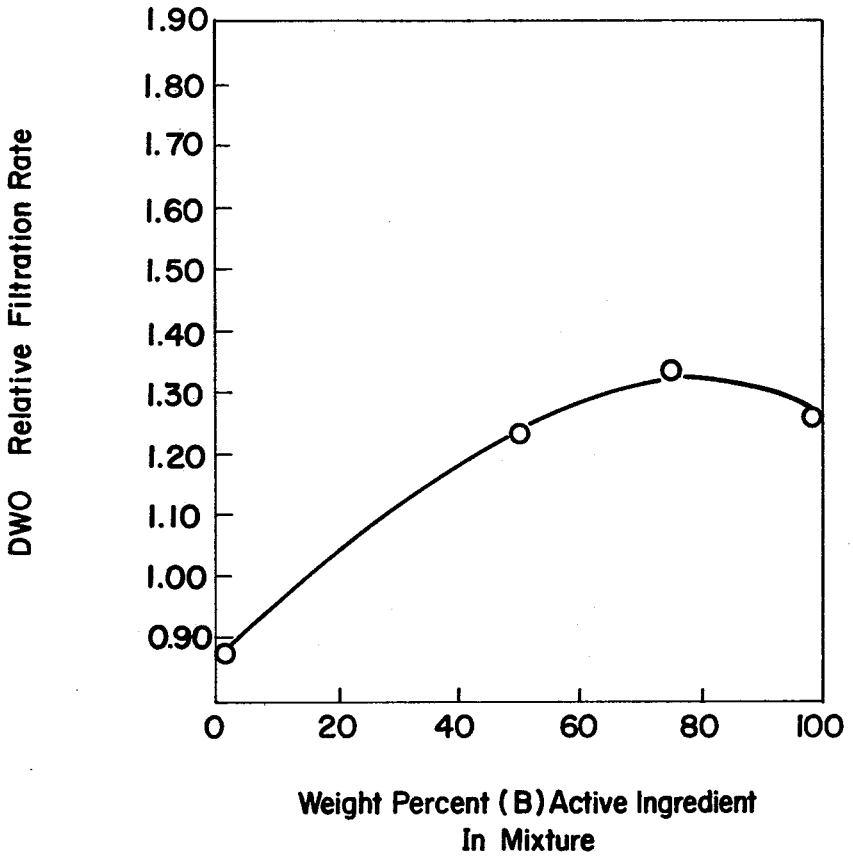

This invention relates to processes for solvent dewaxing waxy bright stock oil employing a dewaxing aid which dewaxing aid is a mixture of (a) poly di alkyl fumarate/vinyl acetate copolymers and (b) a wax-naphthalene condensate. The dewaxing aid mixture is a mixture of (a) poly di alkyl fumarate/vinyl acetate copolymer having a number average molecular weight of about 1,000 to 100,000, preferably 5,000 to 50,000, possessing alkyl side chain moieties of from $C_{16}$–$C_{24}$ in length (excluding branching) with an average pendent side chain length of predominantly (>50%) $C_{20}$ (preferably the pendent alkyl side chain groups are substantially linear, i.e. little or no branching); and (b) a wax-naphthalene condensation product having a number average molecular weight of about 1,000 and greater. The combination (a) plus (b) may be employed in a weight ratio within the range from about 44/55 to 1/100, preferably about ⅓, and at an aid dose level ranging from about 0.005 to 0.2 wt% active ingredient preferably 0.01 to 0.2 wt%.

The solvent dewaxing processes benefited by the use of the present combination dewaxing aid are those using normally liquid solvent systems such as $C_3$–$C_6$ ketones, aromatic hydrocarbons, halogenated hydrocarbons and mixtures thereof.

The waxy oil is a bright stock raffinate from such typical sources as Light Arabian, Kuwait, North Louisiana, West Texas Sour, Western Canadian, Cold Lake heavy crude, etc. The raffinate can be derived from the crude oil or mixture of crude oils by vacuum distillation followed by conventional propane deasphalting of the vacuum residuum to remove the asphaltenes. The resulting deasphalted oil is solvent extracted using either NMP, phenol or furfural, etc., to remove the remaining undersirable aromatics to give a waxy raffinate for subsequent dewaxing. Typical bright stock waxy raffinates have a boiling range of about 500°–700° C., density of about 0.85–0.92 g/cc @ 15° C., a viscosity of about 25–37 cSt/100° C., a pour point of 60°–70° C., a dry wax content of 15–25 wt% for about −9° C. pour point and a Conradson carbon residue value of about 0.3 to 2.0. A typical bright stock, an Arab Light 2500 N oil, was examined and found to have a boiling range of 500°–700° C., a density of 0.89 g/cc @ 15° C., a viscosity of 32 cSt/100° C., a pour point of 65° C. and a dry wax content of 16 wt%. Preferably the bright stock is a lube oil or specialty oil fraction.

The dewaxing aid is advantageously employed as separately prepared components (a) and (b). These components may then be mixed together in the previously recited ratios and added at the desired dose level, either as such or dissolved in a suitable wax-free oil such as mineral oil or other suitable solvent such as toluene, benzene, propane, methylene chloride and the like which imparts to the additive improved flow properties, pumpability, etc. Alternatively, the individual components (a) and (b) can be employed separately (either as such or dissolved in a solvent as previously indicated) and introduced to the dewaxing process simultaneously or sequentially at separate points within the process. The aid, regardless of whether both components are pre-mixed one with the other, or employed separately/simultaneously or separately/sequentially with or without dilution, may be either mixed with the waxy oil prior to chilling, or introduced during the chilling process in either direct chilling means, such as scraped surface chillers, or alternatively, direct chilling means employing cold solvent. Preferred direct chilling means employing cold solvent injected along a number of stages therein a number of which stages are highly agitated insuring instantaneous mixing is the DILCHILL® (registered service mark of Exxon Research and Engineering Company) process as presented in U.S. Pat. No. 3,773,650, hereby incorporated by reference.

The poly di-n-alkyl fumarate/vinyl acetate has pendent alkyl side chains containing from 16 to 24+ carbon atoms, the pendent alkyl side chain length being predominantly $C_{20}$. The component (a) copolymer has a number average molecular weight typically of about 1,000 to 100,000, preferably 5,000 or greater.

U.S. Pat. No. 3,729,296 describes poly dialkyl fumarate/copolymers and a method for their preparation.

A representative poly di-n-alkyl fumaratevinyl acetate copolymer having predominantly $C_{20}$ pendent alkyl side chains (63% $C_{20}$, 25% $C_{22}$, 12% other) possessed a number average molecular weight of about 26,400 and a weight average molecular weight of about 110,000 with a 10–90 mole % number average molecular weight of about 5,000 to 70,000.

Molecular weights were determined by gel perimeter chromatography calibrated on polystyrene.

While the sample presented above was not the exact sample employed in the Examples of the present specification, it is believed it is fairly representative of such samples and serves to demonstrate the general characteristics of the material which satisfies the requirement of the present invention.

The wax-naphthalene condensation product employed as component (b) is a typical Freidel Crafts condensation product prepared in accordance with the procedures outlined in U.S. Pat. Nos. 3,458,430 or 3,910,776.

The normally liquid dewaxing solvent that is used in the present invention is not particularly critical; thus, any of the well-known, normally liquid dewaxing solvents can be used. For example, ketones having from 3 to 6 carbon atoms, such as acetone, dimethyl ketone, methyl ethyl ketone, methyl propyl ketone and methyl isobutyl ketone and mixtures thereof, aromatic hydrocarbons such as benzene, xylene or toluene, mixtures of ketones and aromatic hydrocarbons such as methyl ethyl ketone/toluene or methyl isobutyl ketone/toluene. Also useful are halogenated hydrocarbons such as methylene chloride. Further, N-alkyl-pyrrolidones such as N-methyl-pyrrolidone and N-ethyl-pyrrolidone may be used as the dewaxing solvent. Solvents which may be especially preferred for practicing the process of the present invention include aromatic hydrocarbons such as toluene, $C_5$–$C_6$ ketones such as MEK, MIBK and mixtures thereof, mixtures of a ketone and an aromatic hydrocarbon such as MEK/toluene, halogenated hydrocarbons such as methylene chloride, and mixtures of acetone and methylene chloride.

In an embodiment of the process of this invention, a solution of dewaxing aid comprising components (a) and (b) dissolved in an appropriate solvent such as a light heating oil or a light dewaxed mineral oil fraction is mixed into the wax-containing oil and the mixture heated to a temperature higher than the cloud point of the oil, (typically about 50° C. to 120° C.). The mixture is introduced, along with the dewaxing solvent, into a chilling zone and chilled to a temperature necessary to yield the desired pour point for the resulting dewaxed oil. The chilling produces a slurry comprising dewaxed oil and solvent along with solid particles of wax which contain the dewaxing aid. This slurry is then sent to a filter to separate the dewaxed oil and solvent from the wax particles. The dewaxing temperature or temperature to which the slurry is chilled varies depending on the feed and conditions. In general, this temperature will range from about 0° C. to about −50° C. In the case where the dewaxing solvent comprises a mixture of a ketone and an aromatic hydrocarbon, such as methyl ethyl ketone/toluene, the dewaxing temperature will range from about −10° C. to about −30° C.

Preferred dewaxing solvents used in the process of this invention include mixtures of a ketone and an aromatic hydrocarbon as well as a mixture of a ketone and methylene chloride. The ratio of solvent to waxy oil would generally range from about 0.5 to 10 and preferably from about 2 to 7, by volume. The optimum amount of dewaxing solvent employed is, of course, determined by the wax content of the oil, viscosity, pretreatment and dewaxing conditions.

EXAMPLE 1

The feed preparation apparatus consisted of a 15 cm diameter stainless steel beaker, fitted with a U-shaped, teflon-edged scraper driven at 12 rpm. Chilling rates were controlled by a cooling reservoir surrounding the dewaxing beaker. Measured samples of hot waxy bright stock raffinate and dewaxing solvent were premixed and heated to form a clear solution. The resulting mixture was chilled with scraped surface agitation to the filtering temperature at a specified chilling rate. Filtration was accomplished with a filter leaf equipped with a dual layer of cotton over nylon.

Rotary filter operation was simulated by immersing the filter leaf in the slurry, moving it up and down to provide agitation and applying a pressure differential of 12" Hg across the filter leaf for a required time period. At the end of the required filtration time, the filter leaf was removed and immediately a proportionate amount of wash (prechilled to the filtering temperature) was passed through the cake. The end of the washing period was taken when the last of the wash solvent was just disappearing into the cake. The vacuum was then immediately released and the filter cake and filtrate were collected. After stripping the solvent from the filtrate and filter cake, the weights of dewaxed oil and slack wax were recorded.

Filter rate was calculated in U.S. gallons of dewaxed oil (or feed) per square foot per hour. Yield was expressed as percent dewaxed oil on recovered waxy feed.

An identical dewaxing-filtration procedure was followed with a dewaxing aid added to the waxy oil/solvent mixture. The dewaxing aid was usually dissolved in a small portion of hot oil to form a concentrate, which, in turn, could be dissolved readily in the hot waxy oil/solvent mixture prior to chilling.

The waxy bright stock was an Arab Light 2500N bright stock waxy raffinate, waxy viscosity 26 cSt/100° C. and 94 VI at −9° C. pour.

Component (a) is a poly di-n-alkyl fumarate/vinyl acetate copolymer having side chains comprised of alkyl groups as previously described. This material is characterized by having a pendent alkyl side chain length of predominantly (>50%) $C_{20}$. Poly di-n-alkyl fumarate/vinyl acetate copolymers are generlly prepared by copolymerization of vinyl acetate and di-alkyl fumarate generally following the procedure described in U.S. Pat. No. 3,729,296.

Component (b) is a wax/naphthalene condensation product (51°-53° C. melting point wax) and is of the type generally described and prepared in accordance with the disclosure of U.S. Pat. No. 3,458,430.

The use of these components as a dewaxing aid gave the results in Table I and graphically in FIG. I.

TABLE I

EVALUATION OF WAX-NAPHTHALENE CONDENSATION PRODUCT (PDA-1)/POLY DI-N-ALKYL FUMARATE*-VINYL ACETATE SYNERGISTIC MIXTURE IN ARAB LIGHT BRIGHT STOCK 2500N WAXY RAFFINATE UNDER PREDILUTION CONDITIONS

Solvent = MEK/Toluene (50/50 LV %);
Solvent Dilution Ratio = 4:1 W/W;
Average Chilling Rate = 2.2° C./min;
Filtering Temperature = −23° C.
A.I. = Active Ingredient

| Dewaxing Aid | None | | B | A | B/A | |
|---|---|---|---|---|---|---|
| Consumption, wt % A.I. On Oil Feed | 0 | | 0.10 | 0.10 | 0.10 | |
| Composition, wt % A.I. | | | | | | |
| B | 0 | 0 | 100 | 0 | 75 | 50 |
| A | 0 | 0 | 0 | 100 | 25 | 50 |
| Filtration Cycle (sec)(1) | | | | | | |
| Filter Time | 60 | 60 | 60 | 60 | 60 | 60 |
| Wash Time | 60 | 60 | 60 | 60 | 60 | 42 |
| Wash Solvent/Feed, W/W | 1.6 | 1.7 | 2.9 | 3.6 | 3.5 | 1.9 |
| DWO Yield, wt % | | | | | | |
| Before Cake Wash | 61.8 | 62.2 | 68.2 | 69.7 | 69.7 | 71.2 |
| After Cake Wash | 83.3 | 82.6 | 85.0 | 84.8 | 84.5 | 83.2 |
| Wax Oil Content, wt %(2) | | | | | | |
| Before Cake Wash | 58.1 | 56.8 | 45.5 | 43.0 | 44.0 | 40.7 |
| After Cake Wash | 10.8 | 11.9 | 2.6 | 3.8 | 2.3 | 4.3 |
| Cake Liquids/Solids, W/W | 6.7 | 6.8 | 4.6 | 4.3 | 3.8 | 3.1 |
| DWO Pour/Solid, °C. | −12/−15 | −12/−15 | −12/−15 | −9/−12 | −12/−15 | −12/−15 |
| DWO Filter Rates(3) (USG/Ft²-Hr) | 2.67 | 2.72 | 3.36 | 2.37 | 3.57 | 3.27 |
| DWO Rel. Filtration Rate | 1.00 | 1.00 | 1.25 | 0.88 | 1.33 | 1.22 |

TABLE I-continued

EVALUATION OF WAX-NAPHTHALENE CONDENSATION PRODUCT (PDA-1)/POLY DI-N-ALKYL FUMARATE*-VINYL ACETATE SYNERGISTIC MIXTURE IN ARAB LIGHT BRIGHT STOCK 2500N WAXY RAFFINATE UNDER PREDILUTION CONDITIONS
Solvent = MEK/Toluene (50/50 LV %);
Solvent Dilution Ratio = 4:1 W/W;
Average Chilling Rate = 2.2° C./min;
Filtering Temperature = −23° C.
A.I. = Active Ingredient

| Dewaxing Aid | None | | B | A | B/A | |
|---|---|---|---|---|---|---|
| Feed Rel. Filtration Rate(3) | 1.00 | 1.00 | 1.21 | 0.85 | 1.30 | 1.20 |

(1)No drying applied to filter cake.
(2)Oil contents before cake wash determined by mass balance. Oil contents after cake wash determined with ethylene dichloride at −18° C.
(3)Filter rate calculated for rotary filter, 2½ min/rev, 60 sec filtering. Ave. filter rate of waxy feed in reference runs (no additive) is 3.22 USG/Ft$^2$-Hr.
*The poly di-n-alkyl fumarate-vinyl acetate component is characterized by possessing pendent alkyl side chain groups which are predominantly $C_{20}$.

From this it can be seen that the dewaxing aid combination described in the present specification exhibits a small, but noticeable improvement in the DWO relative filtration rate when used at a rate of A/B of ⅓. Reference to FIG. I reveals that this positive result is obtained when component (a) and (b) are employed in a ratio of A/B of from about 45/55 to about 1/100, preferably ⅓.

What is claimed is:

1. A solvent dewaxing process comprising mixing a waxy hydrocarbon oil bright stock with dewaxing solvent and a dewaxing aid wherein said dewaxing aid comprises a mixture of:

A. poly di alkyl fumarate/vinyl acetate copolymer having alkyl side chain moieties of from $C_{16}$–$C_{24}$+ in length with an average pendent side chain length of predominantly (>50%) $C_{20}$; and B. a wax naphthalene condensation product, wherein components (a) and (b) are used in a weight ratio to each other ranging from about 45/55 to 1/100 of (a) to (b); and chilling said oil/dewaxing solvent-/dewaxing aid mixture to form a slurry comprising solid particles of wax and a solution of dewaxed oil and dewaxing solvent and separating said wax from said solution.

2. The process of claim 1 wherein the poly di alkyl fumarate/vinyl acetate copolymer has a number average molecular weight of about 1,000 to 100,000 and wherein the wax-naphthalene condensation product has a weight average molecular weight of about 1,000 and greater.

3. The process of claim 1 or 2 wherein the dewaxing aid is employed at a dose level ranging from about 0.005 to 2.0 wt.% active ingredient.

4. The process of claim 3 wherein components (a) and (b) constituting the dewaxing aid are used in a weight ratio to each other of ⅓ of (a)/(b).

5. The process of claim 4 wherein said dewaxing solvent is (1) a $C_3$–$C_6$ ketone and mixtures thereof; (2) aromatic hydrocarbons; (3) mixtures of ketones and aromatic hydrocarbons; (4) halogenated hydrocarbons; (5) N-alkyl pyrrolidone; (6) mixtures of acetone and methylene chloride.

* * * * *